US005715914A

United States Patent [19]

Traktovenko

[11] Patent Number: 5,715,914

[45] Date of Patent: Feb. 10, 1998

[54] ACTIVE MAGNETIC GUIDE APPARATUS FOR AN ELEVATOR CAR

[75] Inventor: Boris G. Traktovenko, Avon, Conn.

[73] Assignee: Otis Elevator Company, Farmington, Conn.

[21] Appl. No.: 595,705

[22] Filed: Feb. 2, 1996

[51] Int. Cl.[6] ..... B66B 7/04

[52] U.S. Cl. ..... 187/410; 187/406

[58] Field of Search ..... 187/409, 410, 187/414, 406

[56] References Cited

U.S. PATENT DOCUMENTS

| | | | |
|---|---|---|---|
| 5,107,963 | 4/1992 | Rocca et al. | 187/410 |
| 5,117,946 | 6/1992 | Traktovenko et al. | 187/410 |

FOREIGN PATENT DOCUMENTS

| | | |
|---|---|---|
| 6336383 | 12/1994 | Japan . |
| 710418 | 1/1995 | Japan . |
| 2262932 | 7/1993 | United Kingdom . |

*Primary Examiner*—Kenneth Noland

[57] ABSTRACT

An active magnetic guide apparatus for magnetically stabilizing an elevator car with respect to a guide rail is disclosed. The apparatus includes a magnetic guide assembly for magnetically stabilizing the elevator car with respect to the guide rail and a plurality of mechanical guide assemblies, for mechanically stabilizing the elevator car with respect to the guide rail.

20 Claims, 1 Drawing Sheet

FIG. 1
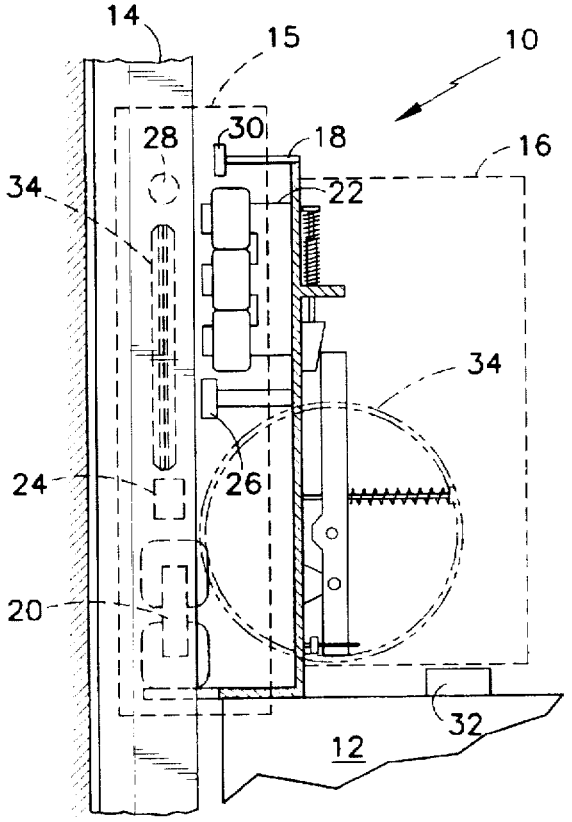
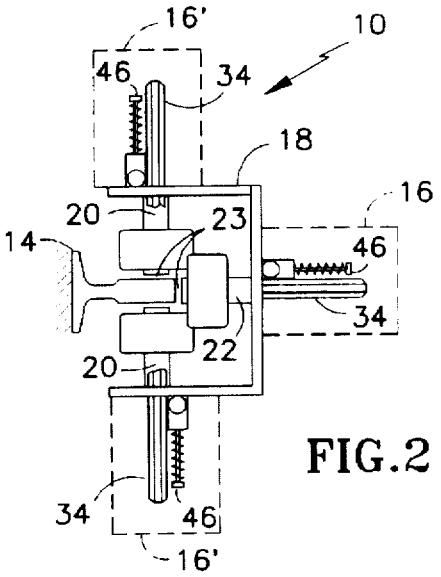
FIG. 2
FIG. 3
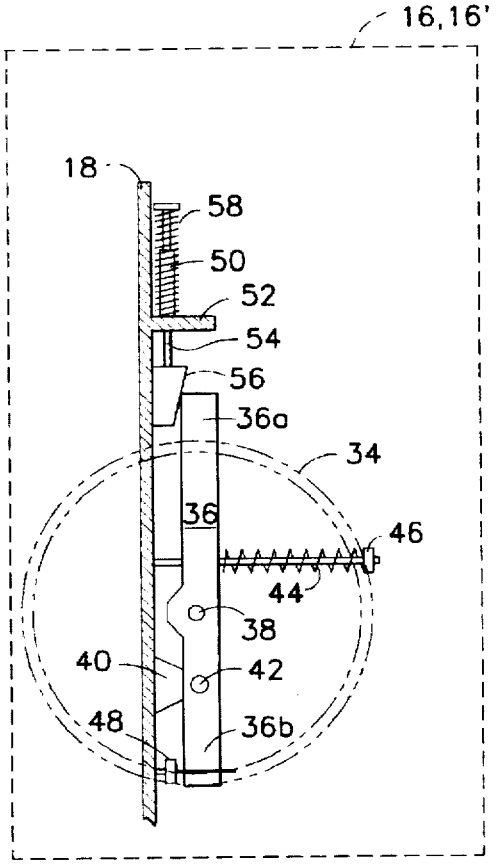

ACTIVE MAGNETIC GUIDE APPARATUS FOR AN ELEVATOR CAR

BACKGROUND OF THE INVENTION

1. Field of the Invention

The present invention relates generally to an improved active magnetic guide apparatus for an elevator car, and in particular, relates to one such apparatus having both a magnetic guide assembly, for magnetically stabilizing the elevator car with respect to the guide rail, and a plurality of mechanical guide assemblies, for mechanically stabilizing the elevator car with respect to the guide rail.

2. Description of the Prior Art

Traditionally, elevator systems have incorporated roller guide systems which guide an elevator car along guide rails as it moves within an elevator hoistway. These systems typically include wheels which are spring biased against the guide rails to provide a conventional passive ride. However, these systems are not well suited for providing a smooth ride at high speeds. Moreover, they can have high maintenance costs because of the large number of moving mechanical parts required.

As an alternative to conventional roller guide systems for high speed elevator car applications, horizontal magnetic stabilization techniques have been implemented in the form of active magnetic guide systems. Magnetic stabilization controls the lateral movements of an elevator car with respect to one or more guide rails without physical contact between the elevator car and the guide rails, providing a smooth ride at any speed. Moreover, these systems require fewer moving mechanical parts than their conventional counterparts.

Active magnetic guide systems typically include a group of magnets which are attached to the elevator car and arranged about each guide rail. Since any contact with the guide rails could easily destroy the magnets, such as during a power failure, these systems typically incorporate a number of interference stops. The interference stops are attached to the elevator car and prevent the magnets from contacting the guide rails.

In addition to interference stops, these systems usually incorporate a conventional roller guide backup system which is engaged when the elevator car is stopped at a floor or whenever the active magnetic guide system fails. Unfortunately, the incorporation of a conventional roller guide system into an active magnetic guide system often significantly increases the height and weight of the guiding assemblies at the corners of the elevator car frame. The added height and weight can result in local resonance frequencies of the car frame that become low enough to adversely affect the stability of the control system. Accordingly, an active magnetic guide apparatus incorporating a conventional roller guide assembly having a compact and light structure resulting in resonance frequencies which are at least an order of magnitude higher than the rolloff frequency of the motion controller is highly desirable.

DISCLOSURE OF THE INVENTION

The present invention is designed to overcome the limitations discussed above and toward that end it includes an improved active magnetic guide apparatus for an elevator car having both a magnetic guide assembly, for magnetically stabilizing the elevator car with respect to the guide rail, and a plurality of mechanical guide assemblies, for mechanically stabilizing the elevator car with respect to the guide rail.

The magnetic and mechanical guide assemblies are uniquely arranged to provide a compact and light structure, assuring that the natural frequency of that structure is an order of magnitude higher than the roll-off frequency of the control system to ensure a stable control system. The weight saving is achieved, at least in part, through a mechanical guide assembly which operates using a pivoting arm and actuator without the use of a motor.

Other advantages will become apparent to those skilled in the art from the following detailed description read in conjunction with the appended claims and drawings attached hereto.

BRIEF DESCRIPTION OF THE DRAWINGS

The drawings, not drawn to scale, include:

FIG. 1, which is a side plan view of an apparatus embodying the principles of the present invention;

FIG. 2, which is a top plan view of the apparatus of FIG. 1; and

FIG. 3, which is an enlarged view one of the mechanical guide assemblies of FIGS. 1 and 2.

BEST MODE FOR CARRYING OUT THE INVENTION

Referring first to FIG. 1, therein illustrated is an improved active magnetic guide apparatus of the present invention, generally indicated by the reference numeral 10, for stabilizing an elevator car 12 with respect to a guide rail 14. The apparatus 10 includes a magnetic guide assembly 15, for magnetically stabilizing the elevator car 12 with respect to the guide rail 14, and three mechanical guide assemblies 16,16' (FIG. 2), attached to the elevator car and arranged about the guide rail 14, for mechanically stabilizing the elevator car 12 with respect to the guide rail 14. As shown in FIGS. 1 and 2, the magnetic guide assembly 15 is completely enclosed within an enclosure 18 while the mechanical guide assemblies 16,16' are externally attached to and partially protrude through the enclosure 18.

As also illustrated in both FIGS. 1 and 2, the magnetic guide assembly 15 includes two front-to-back magnets 20 and one side-to-side magnet 22 which are attached to the elevator car 12 and arranged about the guide rail 14 so that a gap 23 can be controlled between the magnets 20,22 and the guide rail 14 to horizontally "levitate" the elevator car 12 on the guide rail 14. The magnetic guide assembly 15 also includes front-to-back and side-to-side interference stops 24,26 for preventing the magnets 20,22 from contacting the guide rail 14 in the event of a power failure or control system failure. Front-to-back gap and side-to-side gap sensors 28,30, respectively, are also provided for sensing the gap 23 between the magnets 20,22 and the guide rail 14 and providing a gap sensor signal (not shown) to a motion controller (not shown) which, among other things, controls the current applied to the magnets 20,22 to control a gap 23 between the magnets 20,22 and the guide rail 14 so as to provide a smooth ride. The magnetic guide assembly 15 also includes an accelerometer 32 for sensing horizontal acceleration of the elevator car 12 with respect to the guide rail 14 and providing an acceleration signal (not shown) to the motion controller (not shown).

Mechanical guide assemblies 16,16' provide conventional roller guide stabilization when the elevator car 12 approaches a floor stop or if the magnetic guide assembly 15 fails. However, as would be appreciated by one skilled in the art, the mechanical guide assemblies 16,16' could be used, alone or in conjunction with the magnetic guide assembly 15, at any time.

As shown in FIG. 2, three mechanical guide assemblies 16,16' are arranged about the guide rail 14 and aligned with the front-to-back and side-to-side magnets 20,22. (FIG. 1 only shows a portion of one of the front-to-back mechanical guide assemblies 16' so that other parts of the magnetic guide assembly 15 may be shown more clearly.

As best shown in FIG. 3, each of the mechanical guide assemblies 16,16' includes a wheel 34, attached near the midpoint of a pivoting arm 36 by a pin 38. The pivoting arm 36 has a first end 36*a* and a second end 36*b* and is attached to support 40 by a pivot 42, the support 40 in turn being attached to the enclosure 18. Pivoting arm 36 allows the wheel 34 to be selectively positioned with respect to the guide rail 14 as described in more detail below.

The mechanical guide assemblies 16,16' also include a pivoting arm spring 44, mounted on a spring support 46, for biasing the wheel 34 against the guide rail 14. A travel stop 48 is also provided to limit the motion of the pivoting arm 36 and prevent the pivoting arm spring 44 from being overcompressed.

To selectively control the position of the pivoting arm 36, and the wheel 34 with respect to the guide rail 14, the mechanical guide assemblies 16,16' include an actuator 50 supported by an actuator support 52, which is attached to the enclosure 18. The actuator 50 moves a rod 54 and wedge 56 downward and underneath the first end 36*a* of pivoting arm 36, moving the pivoting arm 36 away from the enclosure 18, thus disengaging the wheel 34 from the guide rail 14. Working against the actuator 50 is an actuator spring 58 for retracting the rod 54 and wedge 56 upward from the first end 36*a* of pivoting arm 36, allowing the wheel 34 to engage the guide rail 14, such as in the case of a power failure. The actuator 50 is controlled by the motion controller (not shown) for selectively positioning the wheel 34 with respect to the guide rail 14 as necessary. As would be appreciated by one skilled in the art, the mechanical advantage provided by the use of the wedge 56 under the first end 36*a* of the pivoting arm 36 eliminates the need for a large motor to engage and disengage the wheel 34.

As would further be appreciated by one skilled in the art, the unique vertical integration of the magnets 20,22 and the mechanical guide assemblies 16,16' as shown in FIGS. 1 and 2 provides a compact and light structure. Ordinarily it would be impractical to arrange the magnets 20,22 adjacent to each other around the guide rail 14 at the same vertical level because of the extraordinarily large magnets required to stabilize an elevator car. Accordingly, as shown in FIG. 1, the two mechanical guide assemblies 16' are arranged above front-to-back magnets 20. In addition, the mechanical guide assembly 16 is positioned beneath side-to-side magnet 22 providing a very compact apparatus 10. Moreover, the mechanical guide assemblies 16,16' operate without the use of a motor, thereby minimizing the weight necessary to accomplish its task. As would be appreciated by one skilled in the art, the compact and light structure of the present invention assures that the local natural frequency of the mechanical structure is at least in order of magnitude higher than the roll off frequency of the control system (not shown), providing a margin necessary to maintain a stable control system.

It would be well understood by one skilled in the art that the active magnetic guide apparatus as shown in the drawings could be applied to both the top and bottom of the elevator car 12 for as many guide rails as desired. For example, for an elevator car 12 operating within an elevator hoistway (not shown) having two guide rails 14, the apparatus 10 of the present invention could be installed on the top and bottom of two sides of the elevator car 12.

Although the present invention has been described and discussed herein with respect to one or more embodiments, other arrangements or configurations are possible which do not depart from the spirit and scope hereof. Hence, the present invention is deemed limited only by the appended claims and the reasonable interpretation thereof.

What is claimed is:

1. An apparatus for stabilizing an elevator car with respect to a guide rail, said apparatus comprising:

a. a magnetic guide assembly for magnetically stabilizing the elevator car with respect to the guide rail, the magnetic guide assembly comprising, i. a plurality of magnets attached to the elevator car and arranged about the guide rail, ii. at least one interference stop attached to the elevator car so as to prevent contact between said plurality of magnets and the guide rail; and b. a plurality of adjustable mechanical guide assemblies attached to the elevator car and arranged about the guide rail for mechanically stabilizing the elevator car with respect to the guide rail, each of said mechanical guide assemblies comprising, i. a pivoting arm, having a first end and a second end, said pivoting arm being attached to the elevator car near said second end, ii. a wheel attached to said pivoting arm, iii. an actuator attached to the elevator car, iv. a wedge attached to said actuator and disposed between the elevator car and said first end of said pivoting arm, v. a pivoting arm spring, attached to said pivoting arm, for biasing said pivoting arm against said wedge, whereby, the position of said wheel with respect to the guide rail can be controlled.

2. The apparatus of claim 1, wherein said plurality of magnets further comprises, at least one side-to-side magnet for stabilizing the elevator car with respect to the guide rail in a first direction, and at least one front-to-back magnet for stabilizing the elevator car with respect to the guide rail in a second direction.

3. The apparatus of claim 2, wherein at least one wheel of one of said mechanical guide assemblies is associated with said at least one side-to-side magnet and has a wheel axis that lies in a first plane, and wherein at least one wheel of a remaining one of said mechanical guide assemblies is associated with said at least one front-to-back magnet and has a wheel axis that lies in a second plane parallel to said first plane.

4. The apparatus of claim 2, wherein said at least one side-to-side magnet comprises one magnet and said at least one front-to-back magnet comprises two magnets.

5. The apparatus of claim 1, wherein said plurality of mechanical guide assemblies comprises, at least one side-to-side mechanical guide assembly for stabilizing the elevator car with respect to the guide rail in a first direction, and at least one front-to-back mechanical guide assembly for stabilizing the elevator car with respect to the guide rail in a second direction.

6. The apparatus of claim 5, wherein said at least one side-to-side mechanical guide assembly is one mechanical guide assembly and said at least one front-to-back mechanical guide assembly is two mechanical guide assemblies.

7. The apparatus of claim 1, wherein said magnetic guide assembly further includes an accelerometer for sensing a change in velocity of the elevator car and providing an acceleration signal.

8. The apparatus of claim 1, further comprising a position sensor, attached to the elevator car, for sensing a gap between said plurality of magnets and the guide rail.

9. An apparatus for stabilizing an elevator car with respect to a guide rail, said apparatus comprising:

a. a magnetic guide assembly comprising, a plurality of magnets attached to the elevator car and arranged about the guide rail; and b. a plurality of adjustable mechanical guide assemblies, each of said mechanical guide assemblies comprising, i. a pivoting arm attached to the elevator car, ii. a wheel attached to said pivoting arm, iii. an actuator attached to the elevator car, iv. a wedge attached to said actuator and disposed between the elevator car and said pivoting arm, v. a pivoting arm spring, attached to said pivoting arm, for biasing said pivoting arm against said wedge, whereby, the position of said wheel with respect to the guide rail can be controlled.

10. The apparatus of claim 9, wherein said plurality of magnets further comprises, at least one side-to-side magnet for stabilizing the elevator car with respect to the guide rail in a first direction, and at least one front-to-back magnet for stabilizing the elevator car with respect to the guide rail in a second direction.

11. The apparatus of claim 10, wherein at least one wheel of said mechanical guide assemblies is associated with said at least one side-to-side magnet and has a wheel axis that lies in a first plane, and wherein at least one wheel of a remaining one of said mechanical guide assemblies is associated with said at least one front-to-back magnet and has a wheel axis that lies in a second plane parallel to said first plane.

12. The apparatus of claim 10, wherein said at least one side-to-side magnet comprises one magnet and said at least one front-to-back magnet comprises two magnets.

13. The apparatus of claim 9, wherein said plurality of mechanical guide assemblies comprises, at least one side-to-side mechanical guide assembly for stabilizing the elevator car with respect to the guide rail in a first direction, and at least one front-to-back mechanical guide assembly for stabilizing the elevator car with respect to the guide rail in a second direction.

14. The apparatus of claim 13 wherein said at least one side-to-side mechanical guide assembly is one mechanical guide assembly and said at least one front-to-back mechanical guide assembly is two mechanical guide assemblies.

15. The apparatus of claim 9 wherein said magnetic guide assembly further includes an accelerometer for sensing a change in velocity of the elevator car and providing an acceleration signal.

16. The apparatus of claim 9, further comprising a position sensor, attached to the elevator car, for sensing a gap between said plurality of magnets and the guide rail.

17. A guide assembly for mechanically stabilizing an elevator car with respect to a guide rail, the guide assembly comprising:

a pivoting arm, having a first end and a second end, said pivoting arm being attached to the elevator car near said second end, a wheel attached to said pivoting arm, an actuator attached to the elevator car, a wedge attached to said actuator and disposed between the elevator car and said pivoting arm, a pivoting arm spring, attached to said pivoting arm, for biasing said pivoting arm against said wedge, whereby, the position of said wheel with respect to the guide rail can be controlled.

18. The guide assembly of claim 17, wherein said pivoting arm has a first end and a second end and is supported near said second end, and wherein said wedge is disposed between the elevator car and said first end of said pivoting arm.

19. An apparatus for stabilizing an elevator car with respect to a guide rail having a longitudinal guide rail axis, said apparatus comprising:

a. a magnetic guide assembly comprising a plurality of magnets attached to the elevator car and arranged about the guide rail for magnetically stabilizing the elevator car with respect to the guide rail, said plurality of magnets including, at least one side-to-side magnet for stabilizing the elevator car with respect to the guide rail in a side-to-side direction, and at least one front-to-back magnet for stabilizing the elevator car with respect to the guide rail in a front-to-back direction; and b. a plurality of adjustable mechanical guide assemblies attached to the elevator car and arranged about the guide rail for mechanically stabilizing the elevator car with respect to the guide rail, wherein said plurality of adjustable mechanical guide assemblies include:

at least one front-to-back mechanical guide assembly associated with said at least one side-to-side magnet and spatially disposed in a first plane substantially perpendicular to the longitudinal guide rail axis, and at least one side-to-side mechanical guide assembly being associated with said at least one front-to-back magnet and spatially disposed in a second plane substantially parallel to the first plane.

20. An apparatus for stabilizing an elevator car with respect to a guide rail, said apparatus comprising:

a magnetic guide assembly having a plurality of magnets attached to the elevator car and arranged about the guide rail for magnetically stabilizing the elevator car with respect to the guide rail, said plurality of magnets including at least one side-to-side magnet for stabilizing the elevator car with respect to the guide rail in a side-to-side direction, said at least one side-to-side magnet being spatially disposed at a first level, and at least one front-to-back magnet for stabilizing the elevator car with respect to the guide rail in a front-to-back direction, said at least one front-to-back magnet being spatially disposed at a second level that is different from the first level; and a plurality of adjustable mechanical guide assemblies attached to the elevator car and arranged about the guide rail for mechanically stabilizing the elevator car with respect to the guide rail, said plurality of adjustable mechanical guide assemblies including at least one front-to-back wheel being spatially disposed substantially in the second level associated with said at least one side-to-side magnet, and at least one side-to-side wheel being spatially disposed substantially in the first level associated with said at least one front-to-back magnet.

* * * * *